US007789653B2

(12) United States Patent
Iimura et al.

(10) Patent No.: US 7,789,653 B2
(45) Date of Patent: Sep. 7, 2010

(54) IMPRINTING APPARATUS

(75) Inventors: Yukio Iimura, Shizuoka (JP); Masakazu Kanemoto, Shizuoka (JP); Mitsunori Kokubo, Shizuoka (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 294 days.

(21) Appl. No.: 11/360,505

(22) Filed: Feb. 24, 2006

(65) Prior Publication Data

US 2006/0193938 A1 Aug. 31, 2006

(30) Foreign Application Priority Data

Feb. 25, 2005 (JP) ..... 2005-051757

(51) Int. Cl.
*B29C 59/00* (2006.01)
*B28B 17/00* (2006.01)

(52) U.S. Cl. ..... 425/385; 425/150

(58) Field of Classification Search ..... 425/385, 425/387.1, 388, 149, 150
See application file for complete search history.

(56) References Cited

U.S. PATENT DOCUMENTS 6,873,087 B1 * 3/2005 Choi et al. ..... 310/323.17
6,990,870 B2 * 1/2006 Choi et al. ..... 73/865.9
7,204,686 B2 * 4/2007 Chung et al. ..... 425/385
2004/0251775 A1 12/2004 Choi et al.
2005/0151446 A1 * 7/2005 Marie Hendriks et al. ... 310/328

FOREIGN PATENT DOCUMENTS

| | | |
|---|---|---|
| JP | H02-010427 | 10/1991 |
| JP | 04-146092 | 5/1992 |
| JP | 2000-329528 | 11/2000 |
| JP | 2003-077867 | 3/2003 |
| JP | 2004-259985 | 9/2004 |
| WO | WO 2004-013693 | 2/2004 |

OTHER PUBLICATIONS

Choi, "Design of Orientation Stages or Step and Flash Imprint Lithography", Precision Engineering, Journal of the International Societies of Precision Engineering and Nanotechnology 25, pp. 192-199 (2001).
Office Action issued in counterpart Taiwanese Application No. 95105132 mailed Sep. 23, 2008.
English Language Abstract of Office Action issued in counterpart Taiwanese Application No. 95105132 mailed Sep. 23, 2008.

(Continued)

*Primary Examiner*—Maria Veronica D Ewald
(74) *Attorney, Agent, or Firm*—DLA Piper LLP (US)

(57) ABSTRACT

According to an aspect of the present invention, an imprinting apparatus is provided with: a mount to support a subject body; a movable body capable of moving away from and close to the mount; a support swingably attached to the movable body; a template being attached to the support and including an imprinting face, the imprinting face being patterned to make an impression on the subject body; and a regulator intervening between the movable body and the support and including at least three actuators, the actuators being independently controllably driven so as to regulate an orientation of the imprinting face.

6 Claims, 4 Drawing Sheets

OTHER PUBLICATIONS

Japanese Office Action issued in counterpart Application No. 2005-051757 mailed Aug. 25, 2009.
English Translation of Japanese Office Action issued in counterparat Application No. 2005-051757 mailed Aug. 25, 2009.
English Language Abstract of Japanese Utility Model Application No. H02-010427 dated Oct. 23, 1991.
English Language Abstract of Japanese Publication No. 2004-259985 dated Sep. 16, 2004.
Machine English Translation of Japanese Publication No. 2004-259985 dated Sep. 16, 2004.
English Language Abstract of Japanese Publication No. 2003-077867 dated Mar. 14, 2003.
Machine English Translation of Japanese Publication No. 2003-077867 dated Mar. 14, 2003.
English Language Abstract of Japanese Publication No. 04-146092 dated May 20, 1992.
English Language Abstract of Japanese Publication No. 2000-329528 dated Nov. 30, 2000.
Machine English Translation of Japanese Publication No. 2000-329528 dated Nov. 30, 2000.
Office Action issued in counterpart Japanese Application No. 2005-051757 on Jan. 12, 2010.
English Translation of Office Action issued in counterpart Japanese Application No. 2005-051757 on Jan. 12, 2010.
Decision of Refusal Letter issued in the counterpart Taiwan application No. 95105132 on Mar. 29, 2010.
English Translation of Decision of Refusal Letter issued in the counterpart Taiwan application No. 95105132 on Mar. 29, 2010.

* cited by examiner

IMPRINTING APPARATUS

CROSS-REFERENCE TO RELATED APPLICATIONS

This application is based upon and claims the benefit of priority from the prior Japanese Patent Application No. 2005-051757 (filed Feb. 25, 2005); the entire contents of which are incorporated herein by reference.

BACKGROUND OF THE INVENTION

1. Field of the Invention

The present invention relates to an imprinting apparatus for imprint of a pattern from a template to a subject body and, in particular, to an imprinting apparatus for imprint of a pattern from a template to a subject body with high accuracy in parallelism between the template and the subject body.

2. Description of the Related Art

An art named "nano-imprinting" for forming a nano-sized fine pattern on a resist has been under development in recent years. In the art, a negative pattern as a complement of a desired pattern on the resist is incised on a quartz substrate by an electron beam writing method with nano-sized fineness, which serves as a template (or, a stamper). Next the template is pressed on the resist with a predetermined pressure so as to imprint a positive pattern on the resist. Thereby a desired nano-sized pattern can be formed on the resist. An art of nano-imprinting is disclosed in an article of "Precision Engineering Journal of the International Societies for Precision Engineering and Nanotechnology, 25 (2001) 192-199".

In the aforementioned step of imprinting, it is important for precise formation of the pattern on the resist to closely and uniformly press the template on the resist. Precise regulation in parallelism between the template and the resist is required. For close and uniform pressing, the above article discloses a flexible support which is flexible enough to passively regulate a orientation of the template when the template is pressed to a subject body. However, the flexible support is inapplicable to a case where a pressure to press the template is relatively great, because the flexible support is made so flexible.

Any imprinting apparatus, which is capable of imprinting with a relatively great pressure, is desired.

SUMMARY OF THE INVENTION

According to a first aspect of the present invention, an imprinting apparatus is provided with: a mount to support a subject body; a movable body capable of moving away from and close to the mount; a support swingably attached to the movable body; a template being attached to the support and including an imprinting face, the imprinting face being patterned to make an impression on the subject body; and a regulator intervening between the movable body and the support and including at least three actuators, the actuators being independently controllably driven so as to regulate an orientation of the imprinting face.

According to a second aspect of the present invention, an imprinting apparatus is provided with: a mount to support a subject body; a support to support a template configured to imprint a pattern on the subject body, the support defining an axis and being controllably movable toward the mount along the axis and swingable around the axis; and three or more regulation sets attached to the support and arranged around the axis at intervals, each of the regulation set including an actuator in contact with the support so as to swing the support and a distance measurement device configured to measure a distance to the subject body, the actuator and the distance measurement device being opposed to each other with respect to the axis.

DETAILED DESCRIPTION OF THE INVENTION

Figure 1:
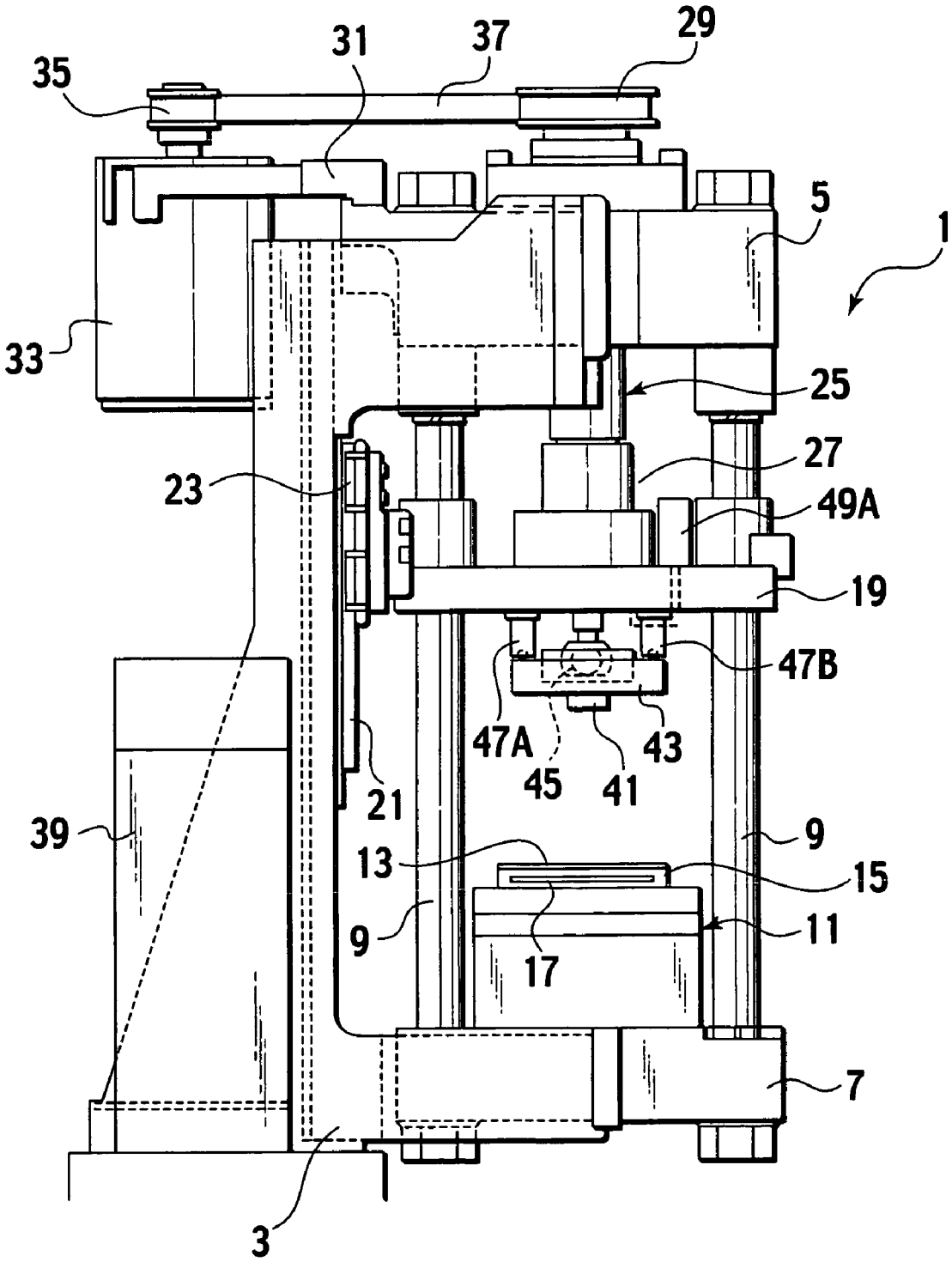
FIG. 1 is an explanatory drawing schematically illustrating an imprinting apparatus in accordance with a first embodiment of the present invention.

Reference is now made to FIG. 1. An imprinting apparatus 1 in accordance with a first embodiment of the present invention is provided with a frame 3 for construction of the whole of the apparatus. The frame 3 is further provided with an upper frame 5, a lower frame 7 and plural (typically four) guide rods 9. The guide rods 9, which also serve as tie rods, stand vertical and parallel with each other. The upper frame 5 and the lower frame 7 are fixed to each other in a unitary body by the parallel guide rods 9. A movable table 11 is attached on the lower frame 7 and is smoothly controllably movable in directions perpendicular to the guide rods, namely in horizontal directions. A supporting mount 15 for supporting a subject body 13 is attached on the movable table 11.

A so-called X-Y table is preferably applied to the movable table 11, which is provided with X and Y tables respectively movable in X and Y directions perpendicular to each other and X and Y servomotors respectively controllably driving the X and Y tables. The X and Y tables are layered with each other so that the movable table 11 is controllably movable in any horizontal directions. Since the X-Y table is publicly known, more detailed description will not be given to the movable table 11. The subject body 13 is a plate provided composed of a substrate of a proper material such as silicon, glass or any ceramics and a resist of a thermoplastic resin having a thickness of from several tens nm to several μm coated on the substrate. The supporting mount 15 is provided with heating means 17 for heating and hence softening the resist, such as a heater.

A movable body 19 is provided so as to span the guide rods 9 and face the support mount 15. Proper bushings such as ball bushings intervene between the movable body 19 and the guide rods 9 for enabling movement of the movable body 19 along the guide rods 9. Thereby the movable body 19 is capable of moving away from and close to the supporting mount 15, like as a ram in a press machine. The frame 3 is provided with a pair of linear guides 21 in parallel with the guide rods 9. A pair of sliders 23 slidably move along the linear guides 21 and are attached to the movable body 19 for guiding the movement of the movable body 19.

More specifically, as the imprinting apparatus 1 is provided with the vertically movable sliders 23 and the parallel plural guide rods 9, the movable body 19 is prevented from moving in the horizontal direction and swinging and enabled to move in the vertical direction with accuracy and keeping the horizontal.

The upper frame 5 is provided with a drive mechanism for driving the movable body 19 in the vertical direction. Hydraulic mechanisms such as a hydraulic cylinder, crank mechanisms and link mechanism are exemplified as preferable examples for the drive mechanism, however, any mechanism enabling controllable, accurate and reciprocal drive may be applied to the drive mechanism of the present embodiment. For convenience of explanation, a ball screw mechanism is exemplified as the drive mechanism to describe the present embodiment.

More specifically, the ball screw mechanism 25 is attached to the upper frame 5 so that a drive rod 27 of the ball screw mechanism 25 is linked with the movable body 19. By rotating a drive nut or a drive screw of the ball screw mechanism 25, the drive rod 27 ascends or descends so as to controllably drive the movable body 19. Meanwhile, whether the drive nut or the drive screw is rotated depends on a constitution of the ball screw mechanism 25 and has no significance for the present invention.

A follower wheel 29 is drivingly attached to the drive nut or the drive screw of the ball screw mechanism 25. The follower wheel 29 is linked with a drive wheel 35 driven by a servomotor 33 via a timing belt 37, which are supported by the upper frame 5 via a bracket 31. More specifically, the servomotor 33 drives the ball screw mechanism 25 via the wheels 29 and 35, the timing belt 37 and such. Alternatively, it may be modified so that the servomotor 33 directly drives the ball screw mechanism 25 without any transfer members.

Therefore, by rotating the servomotor 33 in the regular or reverse direction under control of a controller 39, the movable body 19 vertically controllably descends or ascends along the guide rods 9 and the linear guides 21. A vertical position of the movable body 19 may be detected by detection means (not shown). As examples of the detection means, a rotary detector such as a rotary encoder for detecting a rotational position of the servomotor 33 or a linear scale provided parallel to the linear guide 21 for directly detecting the vertical position may be exemplified.

A support plate 43 to which a template 41 is attached is swingably supported by a lower face of the movable body 19. The lower face of the movable body 19 has a spherical bearing 45 substantially at a center thereof, in a manner that an axial center of the spherical bearing 45 coincides with an axial center of the ball screw mechanism 25. The spherical bearing 45 allows swingable support of the support plate 43. The spherical bearing 45 may be configured to have a general constitution and assures small frictional drag and extremely small play.

The template 41 is made of silicon, glass or any ceramics for example and has a fine pattern for being imprinted on a subject body. The pattern is formed by, for example, an electron beam writing method with nano-sized fineness.

Figure 2:
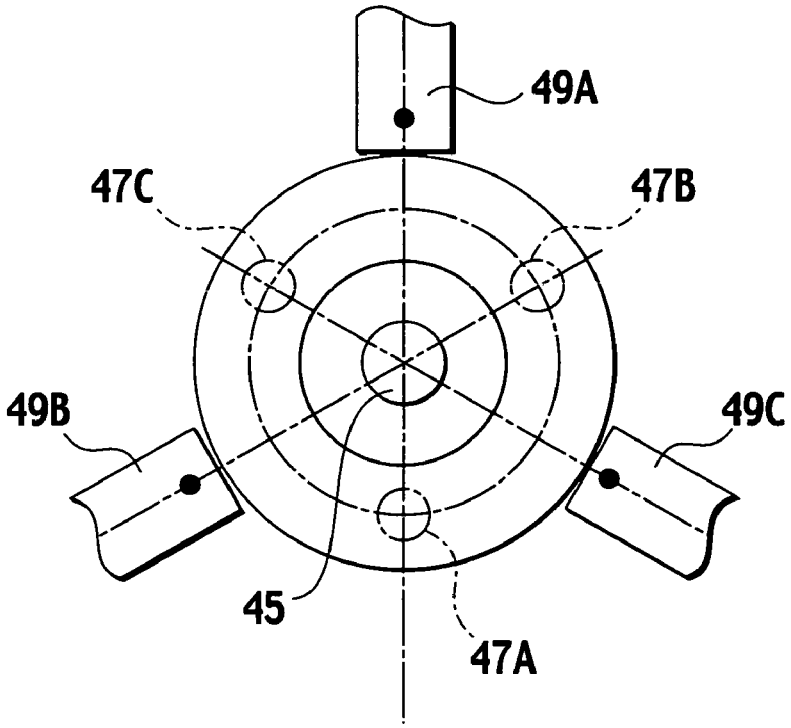
FIG. 2 is an explanatory drawing illustrating a relation between actuators and distance measurement devices of the imprinting apparatus.

At a time of imprinting the pattern on the subject body 13 from the template 41, a deflection angle of the support plate 43 is regulated so as to regulate parallelism between the patterned face of the template 41 and a surface of the subject body 13. For this regulation, three or more actuators 47A, 47B and 47C are provided between the movable body 19 and the support plate 43. The actuators 47A, 47B and 47C are respectively provided with plural accumulated piezoelectric elements (electrostrictive elements) or magnetostrictive elements. By applying respectively controlled voltages, the actuators 47A, 47B and 47C respectively make controlled small deformations. The actuators 47A, 47B and 47C are disposed at even intervals along a circle centered around the center of the spherical bearing 45 as shown in FIG. 2.

The small deformations of the actuators 47A, 47B and 47C controlled by the respectively applied voltages lead to deflection of the support plate 43 centered around the center of the spherical bearing 45. Therefore, by proper regulating the deformations of the actuators 47A, 47B and 47C with the applied voltages, the orientation of the support plate 43 is properly regulated so as to regulate the parallelism between the patterned face of the template 41 and the surface of the subject body 13.

For regulation of the parallelism, distance measurement devices 49A, 49B and 49C are respectively arranged correspondently to and faced to the actuators 47A, 47B and 47C. More specifically, the actuators 47A, 47B and 47C and the distance measurement devices 49A, 49B and 49C are respectively provided as pairs, each of which serves as a regulation set for regulation of the orientation of the support plate 43. The distance measurement devices 49A, 49B and 49C are respectively configured to measure distances from the devices itself to the surface of the subject body 13. To the distance measurement devices, for example, reverberatory CCD displacement sensors with high resolution may be preferably applied.

Figure 3:
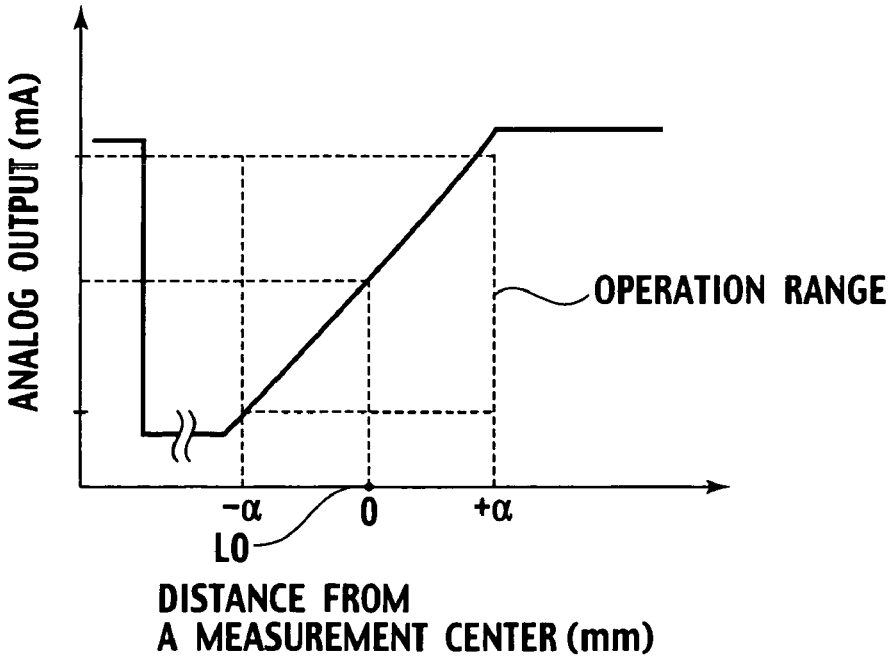
FIG. 3 is a graph illustrating a property of the distance measurement device.

The CCD displacement sensor detects a displacement distance from a particular point as a measurement center L0 and outputs the measured distance as an analog signal, which is in linear relation to the measured distance within a limited range as shown in FIG. 3. A commercially available sensor in the trade name of "Z300-S10" (OMRON corporation) may be preferably applied thereto. As this CCD displacement sensor is capable of detecting displacement with a resolution of 1 μm, a distance between a particular point on the surface of the subject body 13 and the patterned face of the template 41 can be measured with a solution of 1 μm by this sensor.

The distance measurement devices 49A, 49B and 49C are respectively so arranged as to determine compensation quantities required to regulate the actuators 47A, 47B and 47C. In a simplest arrangement, the distance measurement devices may be respectively aligned with the actuators. However, to avoid dimensional interaction between the distance measurement devices and the actuators, the distance measurement devices could be deviated from such aligned positions. In accordance with the present embodiment, the actuators 47A, 47B and 47C and the distance measurement devices 49A, 49B and 49C are arranged as illustrated in FIG. 2. As in the plan view, each of the distance measurement devices 49A, 49B and 49C is disposed on a straight line passing through a center of the correspondent actuator 47A, 47B or 47C and the center of the spherical bearing 45 and opposite to the correspondent actuator 47A, 47B or 47C with respect to the center of the spherical bearing 45. The disposition of the distance measurement devices 49A, 49B and 49C is not necessarily required to be accurate and they may be deviated therefrom to some extent.

More specifically, each of the distance measurement devices 49A, 49B and 49C is on a region opposite to the correspondent actuator 47A, 47B or 47C with respect to a line perpendicular to the center of swinging movement of the support plate 43, namely the center of the spherical bearing 45.

When distances from the devices 49A, 49B and 49C to correspondent points on the surface of the subject body 13 are measured by means of the distance measurement devices 49A, 49B and 49C, voltages for displacement command to regulate the actuators 47A, 47B and 47C are respectively applied thereto, thereby deformations of the actuators 47A, 47B and 47C are regulated in fine tune. Consequently, an orientation of the patterned face of the template 41 is regulated so that parallelism between the patterned face of the template 41 and the surface of the subject body 13 is regulated in fine tune.

Figure 4:
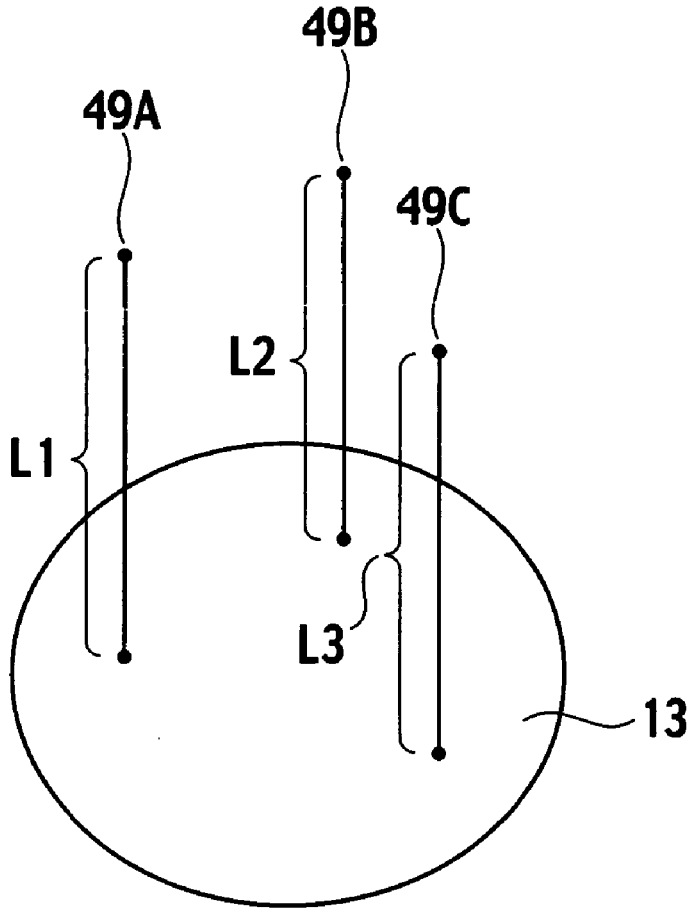
FIG. 4 is an explanatory drawing illustrating measurement by the distance measurement devices.

At a time of carrying out the distance measurement, distances are measured with respect to the measurement center L0. Therefore, provided that values of the distances to the surface of the subject body 13 measured by the distance measurement devices 49A, 49B and 49C are respectively L1, L2 and L3 (see FIG. 4), compensation quantities required to regulate parallelism at the points, where the distance measurement devices 49A, 49B and 49C are disposed, are respectively obtained as these differences from the measurement center L0, namely (L1−L0), (L2−L0) and (L3−L0).

Figure 5:
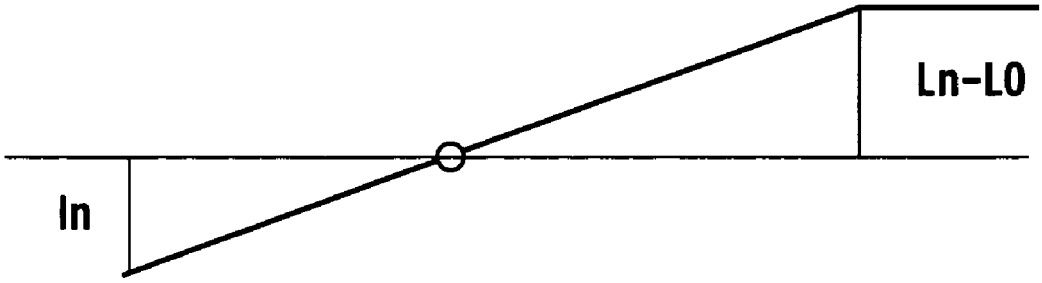
FIG. 5 is an explanatory drawing illustrating a relation between a measured value and a compensated value.

The above compensation quantities should be converted to those at points where the actuators 47A, 47B and 47C are disposed because the distance measurement devices 49A, 49B and 49C are respectively deviated from the actuators 47A, 47B and 47C. Extension of the actuators 47A, 47B and 47C leads to decrease in distances from correspondent points on the patterned face of the template 41 to the surface of the subject body 13. Accordingly, since each of the distance measurement devices 49A, 49B and 49C is arranged opposite to the correspondent actuator 47A, 47B or 47C with respect to the center of the spherical bearing 45 as mentioned above, extension of the actuators 47A, 47B and 47C leads to increase in distances from correspondent distance measurement devices 49A, 49B and 49C to the surface of the subject body 13. This situation is illustrated in FIG. 5. The compensation quantities 11, 12 and 13 required to regulate parallelism at the points, where the actuators 47A, 47B and 47C are disposed, are respectively converted by the following manner.

Figure 6:
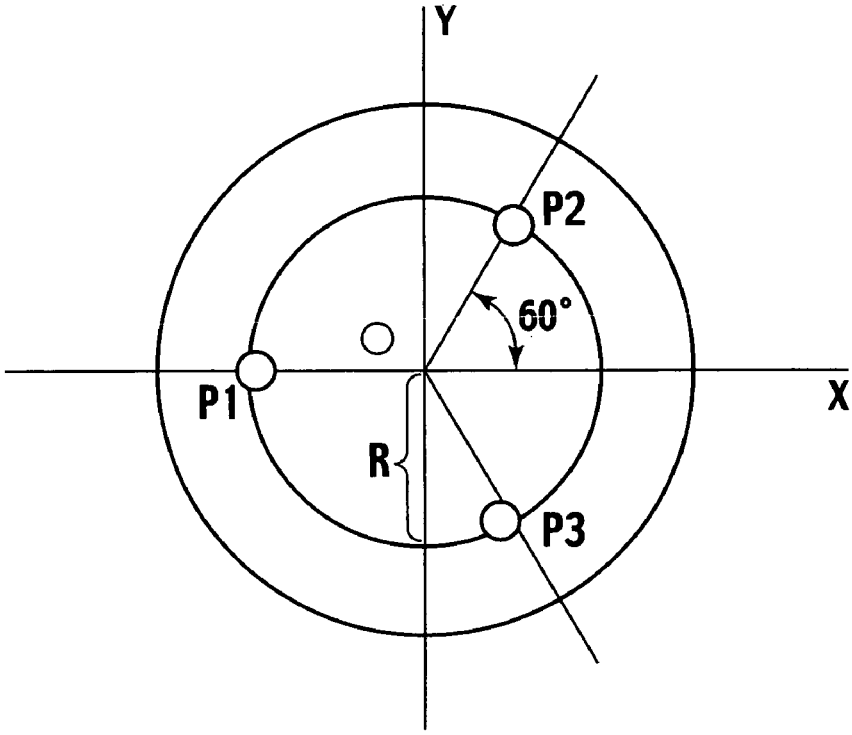
FIG. 6 is an explanatory drawing illustrating an arrangement of the actuators.
Figure 7:
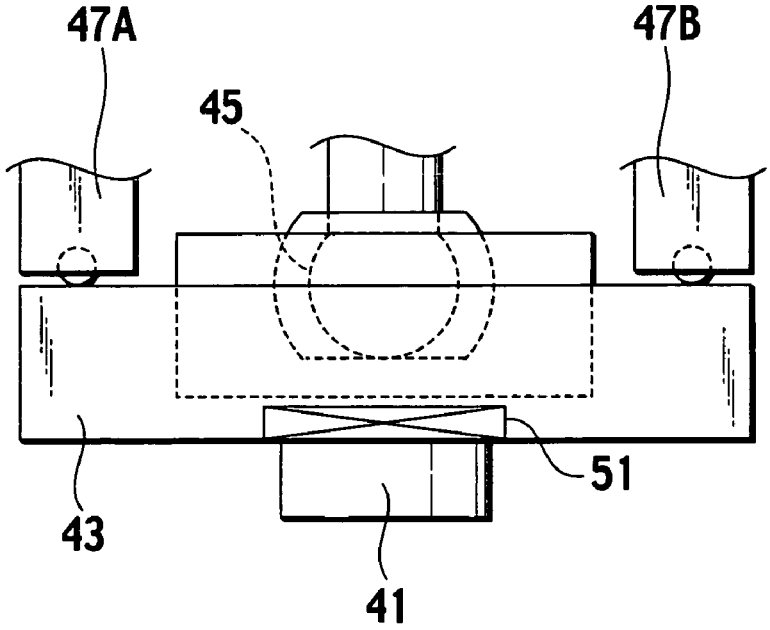
FIG. 7 is an explanatory drawing illustrating an imprinting apparatus in accordance with a second embodiment of the present invention.

For convenience of conversion calculation, the following description will be given on the assumption that the upper surface of the support plate 43 and the rotational center of the spherical bearing 45 are in the same plane at an initial state of not applying any voltage to the actuators. Further an X-Y-Z spatial coordinate system with its origin at the rotational center of the spherical bearing 45, as shown in FIG. 6, is supposed. Meanwhile, points P1, P2 and P3 represent contact points between the actuators 47A, 47B and 47C and the support plate 43. A pitch circle of the points P1, P2 and P3 has a radius R.

Given that voltages applied to the actuators 47A, 47B and 47C respectively yield displacements Δ1, Δ2 and Δ3 thereof, respective coordinates P1, P2 and P3 of tip ends thereof in the X-Y-Z coordinate system are;

$$P1=(-R,0,\Delta 1)$$

$$P2=(R/2,\sqrt{3}/2R,\Delta 2)$$

$$P3=(R/2,-\sqrt{3}/2R,\Delta 3)$$

Planes centered on an origin O are generally represented by an equation of;

$$ax+by+cz=0$$

Because the tip ends are in the plane, the following equations can be obtained;

$$-aR+c\Delta 1=0 \tag{2}$$

$$aR/2+b\sqrt{3}/2\times R+c\Delta 2=0 \tag{3}$$

$$aR/2-b\sqrt{3}/2\times R+c\Delta 3=0 \tag{4}$$

When assigning the equation (2) to the equations (3) and (4);

$$c\Delta 1/2+b\sqrt{3}/2\times R+c\Delta 2=0 \tag{5}$$

$$c\Delta 1/2-b\sqrt{3}/2\times R+c\Delta 3=0 \tag{6}$$

By adding the equation (5) to the equation (6);

$$c(\Delta 1+\Delta 2+\Delta 3)=0 \tag{7}$$

Therefore, Δ1, Δ2 and Δ3 must satisfy the following condition;

$$\Delta 1+\Delta 2+\Delta 3=0 \tag{8}$$

Supposing that the required quantities $l_1$, $l_2$ and $l_3$ given from the condition of the distance measurement devices 49A, 49B and 49C added to an offset Δ are respectively equal to Δ1, Δ2 and Δ3, the following equations are obtained;

$$\left.\begin{aligned}\Delta 1 &= l_1+\Delta\\ \Delta 2 &= l_2+\Delta\\ \Delta 3 &= l_3+\Delta\end{aligned}\right\} \tag{9}$$

By assigning the equations (9) to the equation (8), $l_1+l_2+l_3 3\Delta=0$ and hence;

$$\Delta=-\frac{l_1+l_2+l_3}{3} \tag{10}$$

Therefore, the displacements Δ1, Δ2 and Δ3 which should be given to the respective actuators 47A, 47B and 47C are obtained as;

$$\left.\begin{aligned}\Delta 1 &= \frac{2l_1-l_2-l_3}{3}\\ \Delta 2 &= -\frac{-l_1+2l_2-l_3}{3}\\ \Delta 3 &= \frac{-l_1-l_2+2l_3}{3}\end{aligned}\right\} \tag{11}$$

When voltages in proportion to these values are applied to the respective actuators 47A, 47B and 47C, the template 41 is properly oriented so as to regulate the parallelism.

The controller 39 carries out the aforementioned calculations.

Regulation of the parallelism is carried out as follows. The servomotor 33 drives the movable body 19 to descend under control of the controller 39 so that the measurement centers L0 of the distance measurement devices 49A, 49B and 49C are substantially correspondent with the upper surface of the subject body 13. Subsequently, distances to the upper surface of the subject body 13 are respectively measured by the distance measurement devices 49A, 49B and 49C and the measured values L1, L2 and L3 are input to the controller 39. Then, the required voltages V1, V2 and V3 are calculated therefrom as mentioned above and applied to the actuators 47A, 47B and 47C. Thereby the support plate 43 are controllably oriented so as to regulate the parallelism between the patterned face of the template 41 and the upper surface of the subject body 13.

After regulation of the parallelism as described above, with keeping the orientation of the template 41 in this state, the template 41 is pressed onto a resist on the upper surface of the subject body 13. The resist is preferably heated to soften by means of the heating means 17 in advance. Subsequently, the subject body 13 is cooled so as to harden the resist and then the template 41 is separated from the subject body 13. Thereby a fine pattern is imprinted from the patterned face of the template 41 onto the subject body 13 as an impression thereof.

The controller 39 is preferably provided with storage means for memory of the measured values L1, L2 and L3 and the compensation voltages V1, V2 and V3. When the controller 39 comes to be re-active, the orientation of the template 41 can be restored from the stored data. Thereby imprinting by the template 41 can be repeatably and stably carried out in the consistent condition until the template 41 is exchanged.

Meanwhile, the aforementioned description was given to a case where the thermoplastic resist on the subject body 13 is heated to soften and then imprinting is accomplished. However, the present invention may be applied to a case where an ultraviolet curing resist is used. In this case, it is preferred that the template 41 is constituted transparent and a light source 51 is attached to the support plate 43. Alternatively, a light source 51 and an optical guide-way to conduct light of the light source are preferably provided in combination.

In stead of the CCD displacement sensors as described above, laser displacement sensors, LED displacement sensors, ultrasonic sensors or contact displacement sensors for example may be applied to the distance measurement devices 47A, 47B and 47C. Moreover, the above description was given to the upright imprinting apparatus, however, the imprinting apparatus may be constituted and used as a horizontal apparatus.

As being understood from the above description, the imprinting apparatus in accordance with the present embodiment of the present invention is capable of closely and uniformly pressing the template onto the subject body. Since the apparatus is free from a flexible support, relatively large pressure can be applied to imprinting though precision is not degraded. Moreover, precise imprinting can be carried out independent of the material quality of the subject body and whether it is soft or hard.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An imprinting apparatus comprising:

a mount to support a subject body;

a support to support a template configured to imprint a pattern on the subject body, the support defining an axis and being controllably movable toward the mount along the axis and swingable around the axis;

three or more regulation sets attached to the support and arranged around the axis at intervals, each of the regulation set including an actuator in contact with the support so as to swing the support to position the support in a desired angular orientation relative to the subject body and maintain the angular orientation, and a distance measurement device configured to measure a distance to the subject body, the actuators and the distance measurement devices of the three or more regulation sets being respectively arranged correspondently to each other; and a controller configured to calculate regulation voltages to drive the actuators from values respectively measured by the distance measurement devices so that the orientation is three-dimensionally regulated to keep parallelism between the imprinting face of the template and a surface of the subject body.

2. The imprinting apparatus of claim 1, wherein the support includes a heater to heat the subject body.

3. The imprinting apparatus of claim 1, further comprising:

a luminair to illuminate the template, the luminair including one selected from the group of a light source attached to the support and an optical guide-way attached to the support to conduct light of an external light source.

4. The imprinting apparatus of claim 1, wherein each of the actuators includes one selected from the group of a piezoelectric element and a magnetostrictive element.

5. The imprinting apparatus of claim 1, wherein each distance measurement device includes a CCD displacement sensor, a laser displacement sensor, a LED displacement sensor, an ultrasonic sensor or a contact displacement sensor.

6. The imprinting apparatus of claim 1, wherein the regulated voltage calculation includes accounting for a deviation between a location of each of the plural distance measurement devices and a location of a corresponding actuator.

* * * * *